United States Patent [19]

Hirano

[11] 4,437,776

[45] Mar. 20, 1984

[54] PRINTING MECHANISM

[75] Inventor: Hirofumi Hirano, Arakawa, Japan

[73] Assignee: Canon Denshi Kabushiki Kaisha, Saitama, Japan

[21] Appl. No.: 356,101

[22] Filed: Mar. 8, 1982

[30] Foreign Application Priority Data

Mar. 30, 1981 [JP] Japan ..... 56-46635

[51] Int. Cl.[3] ..... B41J 1/34

[52] U.S. Cl. ..... 400/142; 400/145.2

[58] Field of Search ..... 400/142, 145.1, 145.2; 101/93.19

[56] References Cited

U.S. PATENT DOCUMENTS

| | | | |
|---|---|---|---|
| 3,077,256 | 2/1963 | Ruderfer | 101/93.19 X |
| 3,717,234 | 2/1973 | Koller | 400/145.2 |
| 3,807,301 | 4/1974 | Decker | 400/161 X |

*Primary Examiner*—Clifford D. Crowder

*Attorney, Agent, or Firm*—Fitzpatrick, Cella, Harper & Scinto

[57] ABSTRACT

A printing mechanism has a type drum which rotates in a plane that extends perpendicularly to the feeding direction of a printing paper sheet, and a control assembly for rotating and for shifting the type drum along a printing line. During printing, the type on the type drum is struck against the printing paper sheet while it is translated in the shifting direction.

3 Claims, 12 Drawing Figures

PRINTING MECHANISM

BACKGROUND OF THE INVENTION

The present invention relates to a printing mechanism for a printer of the serial printing type which is generally adapted for use in a desk-top calculator or the like.

A conventional serial printer prints sequentially. Therefore, in order to achieve a faster printing speed, the printing time and shifting time of a type drum must be shortened, and the type drum must also be rotated more rapidly. In a flying hammer-type printer, since the type drum is not stopped, the printing time is reduced. However, if the type drum is rotated at a higher frequency, unsatisfactory printing such as incomplete printing or irregular printing occurs. Since the type drum is typically shifted by one character pitch during one revolution of the drum, only one character can be printed upon each revolution of the drum, imposing a limit for a higher printing speed. In a printer of the stationary printing type, the printing quality is guaranteed if the drum is locked at a predetermined position. Although the type drum can be rotated at a high frequency a DC motor is, in most cases, adapted to drive the drum to reduce power consumption. Therefore, a clutch is required between the DC motor and the type drum. A printer of this type requires time for printing with the drum at a fixed position and shift time after printing for shifting the drum to the next character to be printed, also imposing a limit on a higher printing speed.

SUMMARY OF THE INVENTION

It is an object of the present invention to provide a printing mechanism which mitigates the drawbacks of conventional printers and which is capable of simultaneously performing printing and shifting of a type drum so as to achieve high speed printing which has hitherto been impossible to perform.

It is another object of the present invention to provide a printing mechanism which is simple in construction, small in size and inexpensive to manufacture.

BRIEF DESCRIPTION OF THE DRAWINGS

FIGS. 4B1 to 4B3 are schematic views showing the movement of a type section;

DETAILED DESCRIPTION OF THE PREFERRED EMBODIMENTS

The preferred embodiments of the present invention will now be described with reference to the accompanying drawings.

Figure 1A:
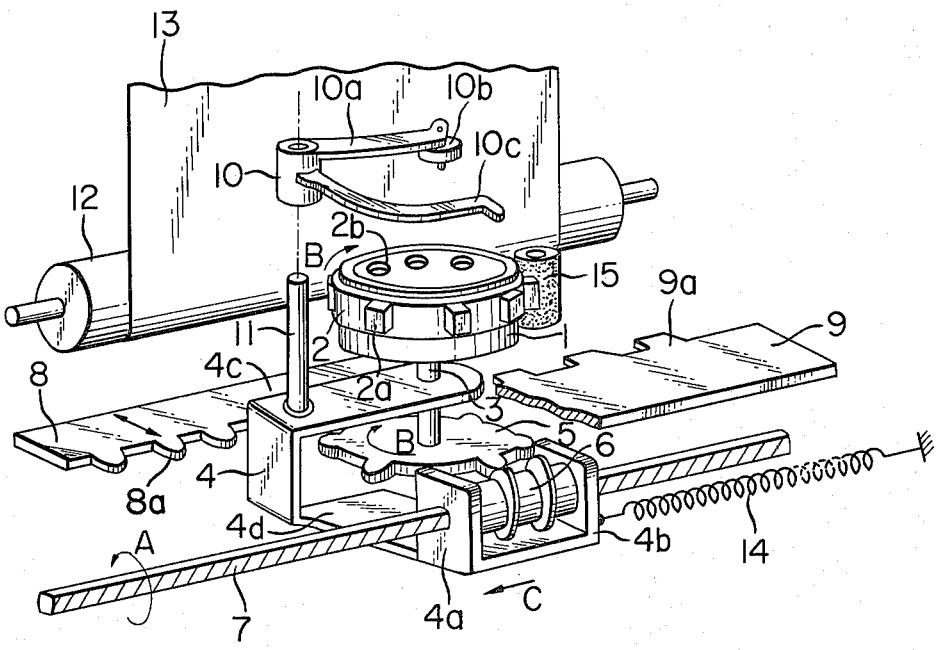
FIGS. 1A and 1B are a perspective view schematically showing a printing mechanism and a sectional view of a type drum according to the present invention.
Figure 1B:
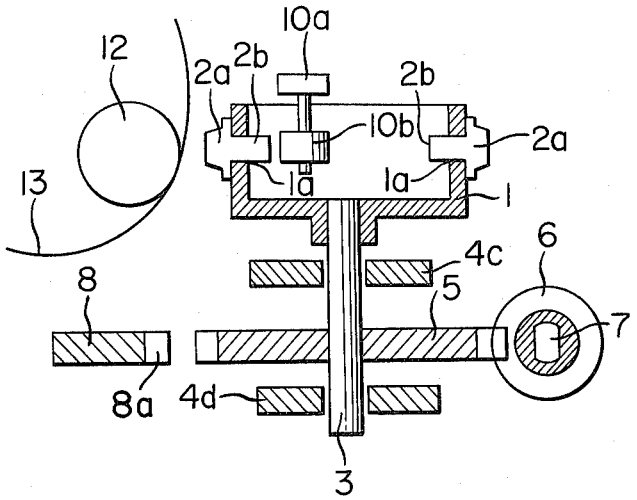

FIGS. 1A and 1B are a perspective view and a sectional view showing the overall configuration of a printing mechanism according to an embodiment of the present invention. A type drum base 1 has a plurality of holes 1*a* in its outer circumference. A type belt 2 consisting of an elastic member of rubber, for example, is wound around the outer circumference of the type drum base 1. The type belt 2 has a plurality of type 2*a* each associated with one projection 2*b* that is fitted in one hole 1*a* opposite to the associated type 2*a*. When a projection 2*b* is struck outwardly from the inner circumference of the type drum base 1, the corresponding type 2*a* projects outwardly.

A drum shaft 3 is fixed, at its one end, to the type drum base 1 and is rotatably supported by a carrier 4. A drive gear 5 is fixed to the other end of the drum shaft 3. Accordingly, the drum may rotate in a plane extending perpendicularly to the direction of feed of a printing paper sheet 13 wound about a cylindrical platen 12.

The thrust movement of a worm gear 6 is regulated by bent portions 4*a* and 4*b* of the carrier. The worm gear 6 meshes with the drive gear 5 and is mounted on a worm gear shaft 7.

The worm gear shaft 7 is rotatably supported between side plates (not shown) and is rotated at a predetermined frequency by a drive motor (not shown). The worm gear 7 has a cross section which is substantially elliptical. The worm gear shaft 7 slidably fits inside a hole having the corresponding shape and formed in the worm gear 6 (FIG. 1B).

A type drum base control member 8 has rack teeth 8*a*. When the type drum base control member 8 is urged toward the type drum base 1 by a solenoid (not shown), it engages with the drive gear 5. A printing cam 9 has, at its one end face, cam portions 9*a* for actuating a printing hammer 10 in a manner to be described later.

The printing hammer 10 has an arm 10*a* holding a roller 10*b* for striking the projections 2*b* each corresponding to one type 2*a*, and a strike arm 10*c* to engage the printing cam 9. The printing hammer 10 is rotatably mounted on a fixed hammer shaft 11 fixed on the carrier 4.

As noted, the printing paper sheet 13 is wound around the platen 12. An ink roller 15 abuts the type drum to transfer ink onto the type surface.

The carrier 4 is guided by a guide shaft (not shown) to be movable parallel to the axis of the platen 12. A return spring 14 constantly biases the carrier 4 in one direction.

The mode of operation of the printing mechanism of this embodiment of the above configuration will now be described with reference to FIGS. 1 to 4.

Figure 2A:
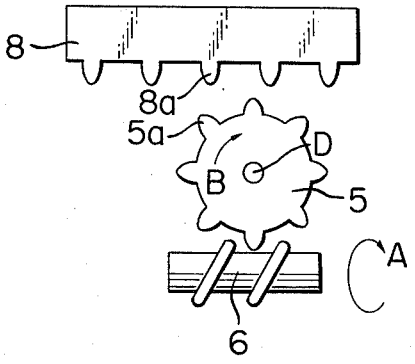
FIGS. 2A to 2C are schematic views showing the mode of operation for character selection and shifting of the type drum.
Figure 2A:
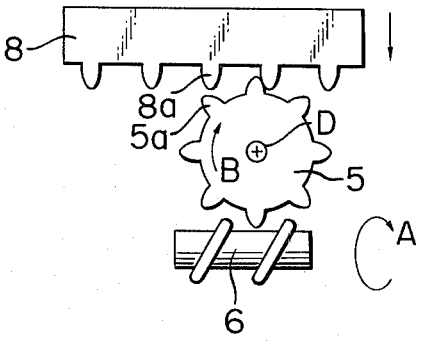
Figure 3A:
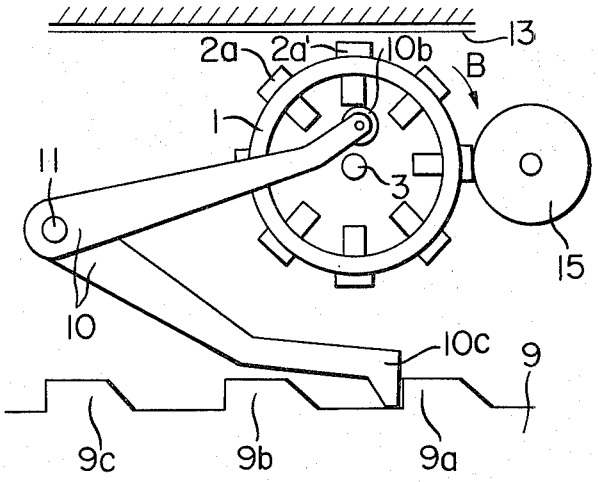
FIGS. 3A to 3C are schematic views showing the printing operation.

When the worm gear shaft 7 rotates in the direction A, the worm gear 6 engaging therewith also rotates in the same direction. Since the drive gear 5 meshes with the worm gear 6, the drive gear 5 also rotates in the direction B. At the same time, the type drum base 1 fixed to the drum shaft 3 also rotates in the direction B (FIGS. 2A and 3A).

When printing with a desired type 2*a* is to be performed, the control member 8 is pressed to move forward by a solenoid (not shown) so as to engage at a predetermined position of the drive gear 5. Thus, one rack tooth 8*a* of the control member 8 meshes with one tooth 5*a* of the drive gear 5 (FIG. 2A').

Figure 2B:
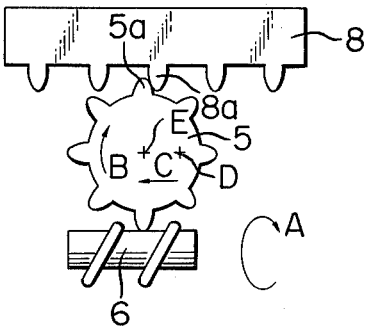

Since the rotational force developed by the worm gear 6 is still acting on the drive gear 5, the drive gear 5 continues to rotate about the rack tooth 8*a* of the base control member 8 as a fulcrum. As a result, the center of rotation of the drive gear 5 shifts from point D to point E (FIG. 2B). This state may be analogous to the rolling movement of the pinion on the rack.

Figure 2C:
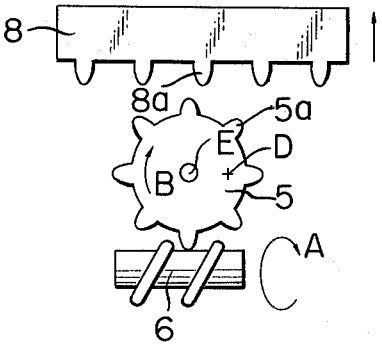
Figure 3B:
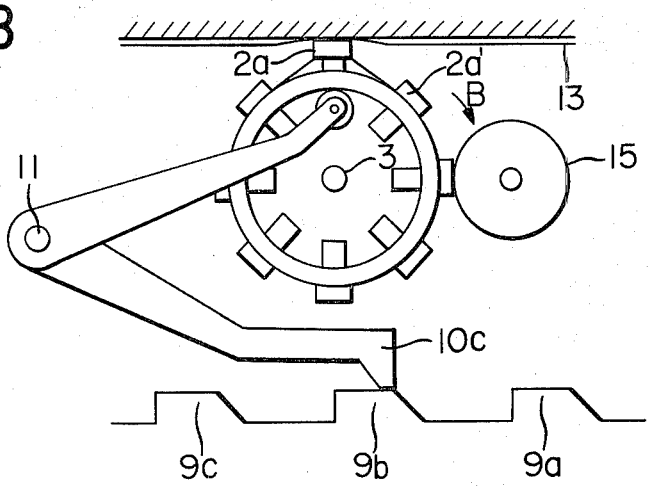
Figure 3C:
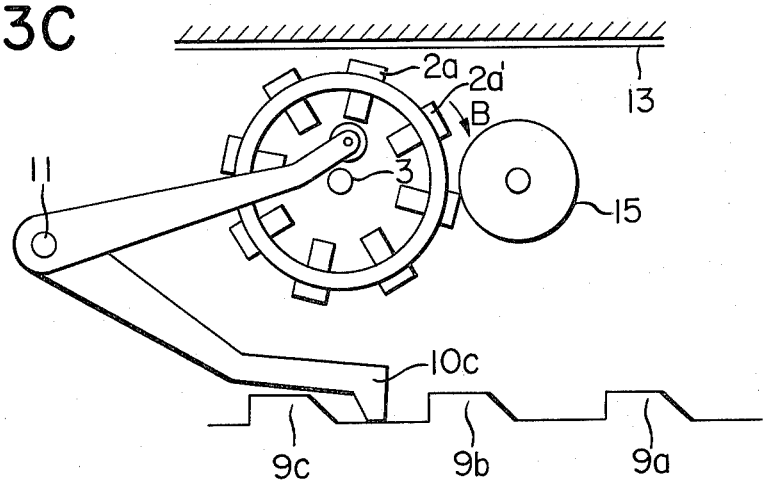
Figure 4:
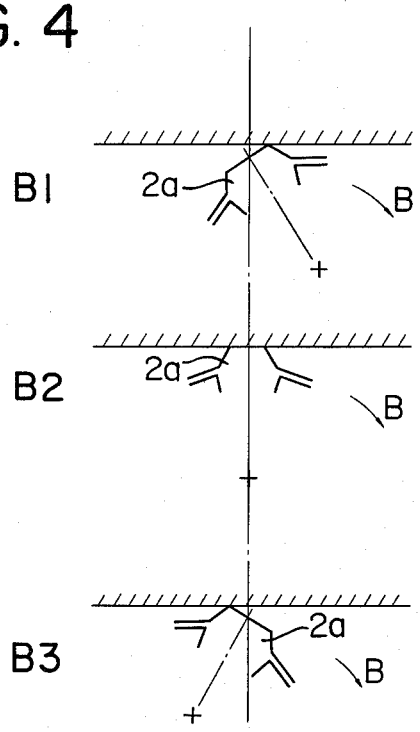

When the type drum 1 moves in the shift direction c by rolling, the carrier 4 also moves in the shift direction c. As has been described above, the printing hammer 10 is rotatably mounted on the carrier 4, and the strike arm 10*c* of the printing hammer 10 is engaged with a cam portion 9*a* of the printing cam 9. When the printing hammer 10 moves in the shift direction c together with the carrier 4, the strike arm 10*c* moves onto the cam portion 9*a*, and the roller 10*b* strikes a projection 2*b* of the type belt 2. Then, the type is brought into contact with the printing paper sheet 13 for transferring ink thereon (FIG. 3B). Subsequently, the carrier 4, the type drum base 1 and the printing hammer 10 integrally move in the shift direction c. When the strike arm 10*c* of the hammer 10 moves over the cam portion 9*a* of the printing cam 9, the type is separated from the printing paper sheet 13 and the printing operation is completed (FIGS. 2C and 3C). If the solenoid urging the control member 8 is deenergized and the rack tooth 8*a* of the control member 8 is disengaged from the drive gear 5 in this condition, the type drum 1 stops rolling and continues rotating from the stopped position (FIGS. 2C and 3C). Although the return spring 14 is biasing the carrier 4, the carrier 4 is not returned since the strike arm 10*c* of the printing hammer 10 engages with a cam portion 9*b* of the printing cam 9 (FIG. 3C). When one line is printed in a similar manner and the printing cam 9 is moved away from the type drum 1, the strike arm 10*c* of the hammer 10 is disengaged from the cam portion and returns to the predetermined position by the biasing force of the return spring 14. If the printing characters are continuous as in the case of 1, 2, 3, 4 and so on during printing of one line, the type prints the characters and shifts sequentially upon single operation of the control member 8, resulting in high speed printing. If the module of the teeth of the drive gear 5 is represented by m, the printing pitch (character pitch) is represented by $m\pi$. It follows from this that the rack teeth pitch of the control member 8 and the cam pitch of the printing cam 9 are also $m\pi$. FIGS. 4B1 to 4B3 are similar to the view of FIG. 3B but expanded in time.

Figure 5:
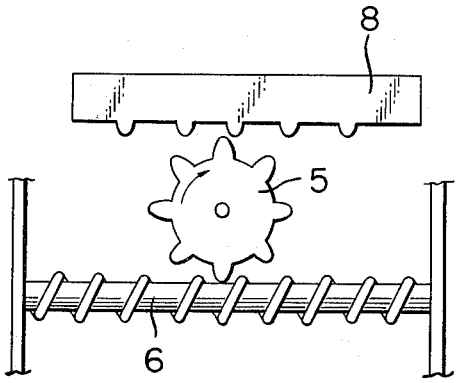
FIG. 5 shows another embodiment of the present invention.

FIG. 5 shows another embodiment of the present invention. According to this embodiment, the worm gear is elongate, extending throughout the range of movement of the type drum. With the first embodiment of the present invention described above, since printing and shifting is performed within the shifting time between the characters, the fluctuation of the load exerted on the motor is great. The second embodiment is effective to reduce this fluctuation in the load on the motor.

Figure 6:
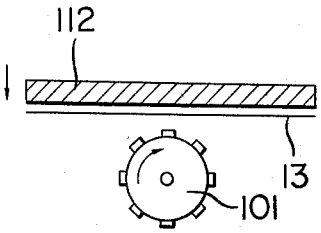
FIG. 6 is a view showing still another embodiment of the present invention.

FIG. 6 shows still another embodiment of the present invention. According to this third embodiment, the printing paper sheet 13 is struck against a type drum 101 by a platen hammer 112. In this case, the striking timing of the hammer must fall within the time period during which the type drum rolls. The rest of the arrangement remains the same as that of the first embodiment.

As may be apparent from the above description, the present invention provides the following advantages:

(1) Since the printing time and the shifting time roughly correspond to each other, a high speed printer may be realized.

(2) Although the type drum is not stopped for printing, a relatively long time is allowed for striking the type, so that the occurrence of unsatisfactory printing such as incomplete printing, irregular printing or the like may be minimized. In addition, since the transfer of ink is easy, a printer of good printing quality may be obtained.

(3) A special mechanism such as a clutch is not required, so that a printer is provided which is simple in construction, small in size and inexpensive to manufacture.

What I claim is:

1. A printing mechanism for printing characters on a recording medium, such as a paper sheet, that is fed in a feeding direction, said mechanism comprising:

a type drum mounted for rotation in a plane that extends perpendicularly to the feeding direction and for translation in a shift direction extending along a line on which characters are to be printed on the recording medium;

a plurality of character type carried on said type drum; and control means for simultaneously causing one of said type to strike said recording medium and translating said type drum in said shift direction, said control means comprising a pinion gear fixed to said type drum for rotation therewith and a rack gear extending in said shift direction and selectively engageable with said pinion gear, wherein said type drum is translated in said shift direction during rotation thereof when said rack gear engages said pinion gear.

2. A printing mechanism according to claim 1, further comprising a rotatable worm gear engaged with and for driving said pinion gear, and wherein said rack gear is engageable with said pinion gear to lock it in correspondence with the pitch of said worm gear.

3. A printing mechanism according to claim 1, wherein said type drum comprises a drum base and a hollow cylinder extending axially from said base, said mechanism further comprising a type belt of an elastic material mounted about said cylinder and carrying on a surface thereof, said type.

* * * * *